US011737500B2

(12) United States Patent
Somogye et al.

(10) Patent No.: US 11,737,500 B2
(45) Date of Patent: Aug. 29, 2023

(54) ENHANCERS FOR USE WITH GARMENTS

(71) Applicant: CINMAR, LLC, Chesterfield, MO (US)

(72) Inventors: Cynthia Somogye, Chesterfield, MO (US); Margaret Seeger, Elsberry, MO (US); Corey Feit, St. Louis, MO (US); Lauren Smith Bearden, St. Charles, MO (US)

(73) Assignee: CINMAR, LLC, Chesterfield, MO (US)

( * ) Notice: Subject to any disclaimer, the term of this patent is extended or adjusted under 35 U.S.C. 154(b) by 0 days.

(21) Appl. No.: 17/459,498

(22) Filed: Aug. 27, 2021

(65) Prior Publication Data

US 2023/0065905 A1 Mar. 2, 2023

(51) Int. Cl.
*A41C 3/14* (2006.01)

(52) U.S. Cl.
CPC ..... *A41C 3/144* (2013.01)

(58) Field of Classification Search
CPC ... A61F 2/42; A61F 2002/523; A41B 2400/62
USPC ..... 623/7
See application file for complete search history.

(56) References Cited

U.S. PATENT DOCUMENTS 2,482,297 A * 9/1949 Silverman ..... A61F 2/52 623/7
2,959,173 A * 11/1960 Douthit ..... A41C 3/144 450/156
3,017,221 A 1/1962 Emery
3,278,947 A * 10/1966 Silverman ..... A61F 2/52 623/7
3,304,558 A * 2/1967 Mann ..... A61F 2/52 623/7

(Continued)

FOREIGN PATENT DOCUMENTS

GB 3014508 1/2004

OTHER PUBLICATIONS

Silicone Lift Bra for Women, Reusable Silicone Covers, [online]; [published to the internet Jul. 1, 2022]; URL: https://www.amazon.com/Silicone-Women-Reusable-CoversInvisible/dp/B0895VHLGC/ref=cm_cr_arp_d_product_top?ie=UTF8. (8 pages). (Year: 2022).

(Continued)

*Primary Examiner* — Jocelyn Bravo
(74) *Attorney, Agent, or Firm* — Harness, Dickey & Pierce, P.L.C.

(57) ABSTRACT

An enhancer for simulating breast tissue includes a first layer of material and a second layer of material coupled to the first layer of material, where the second layer of material includes a wicking material. The enhancer also includes an third layer of material and a fourth layer of material both disposed generally between the first layer of material and the second layer of material. The third layer of material includes a plurality of monprene beads, and the fourth layer of material includes a plurality of open cell poly foam pieces. The enhancer further includes a fifth layer of material disposed at least partly between the third layer of material and the fourth layer of material, where the fifth layer of material is configured to inhibit mixing of the monprene beads of the third layer and the open cell poly foam pieces of the fourth layer.

19 Claims, 14 Drawing Sheets

(56) References Cited

U.S. PATENT DOCUMENTS

| | | | | | |
|---|---|---|---|---|---|
| 3,366,975 | A * | 2/1968 | Pangman | A61F 2/12 | 623/8 |
| 3,665,520 | A | 5/1972 | Perras | | |
| 3,896,506 | A | 7/1975 | Hankin | | |
| 3,911,503 | A | 10/1975 | Hankin | | |
| 4,019,209 | A | 4/1977 | Spence | | |
| 4,071,914 | A * | 2/1978 | Silverman | A61F 2/52 | 623/7 |
| 4,125,117 | A * | 11/1978 | Lee | A61F 2/52 | 623/7 |
| 4,172,298 | A | 10/1979 | Rechenberg | | |
| 4,385,131 | A * | 5/1983 | Fracalossi | C08J 9/35 | 428/319.3 |
| 4,438,220 | A * | 3/1984 | Fracalossi | C08J 9/35 | 521/137 |
| 4,676,795 | A * | 6/1987 | Grundei | A61F 2/52 | 623/8 |
| 4,681,587 | A * | 7/1987 | Eberl | A61F 2/52 | 623/7 |
| 4,701,230 | A * | 10/1987 | Loi | A61F 2/52 | 623/7 |
| D382,962 | S | 8/1997 | Schaffner | | |
| 5,902,335 | A * | 5/1999 | Snyder, Jr. | A61F 2/52 | 623/7 |
| 5,961,552 | A * | 10/1999 | Iversen | A61L 27/18 | 623/7 |
| 6,398,810 | B1 * | 6/2002 | Surprise | A61F 2/52 | 623/7 |
| 6,443,806 | B1 | 9/2002 | Fang | | |
| 7,461,424 | B2 | 12/2008 | Lindell | | |
| 7,575,596 | B2 | 8/2009 | Bowman | | |
| 7,628,811 | B1 * | 12/2009 | Gaskill | A61F 2/52 | 623/7 |
| D628,768 | S | 12/2010 | Fei | | |
| D655,476 | S | 3/2012 | Naughton | | |
| 8,562,388 | B2 * | 10/2013 | Izzo | A61F 2/52 | 450/57 |
| D775,452 | S | 1/2017 | Brownell | | |
| 10,583,016 | B2 * | 3/2020 | Valdiserra | A61F 2/5046 | |
| D945,740 | S | 3/2022 | Szilagyi | | |
| 2007/0039086 | A1 * | 2/2007 | Moore | A01K 27/001 | 2/338 |
| 2007/0055371 | A1 * | 3/2007 | Laghi | A61F 2/52 | 450/55 |
| 2007/0161328 | A1 | 7/2007 | Munn | | |
| 2007/0293945 | A1 * | 12/2007 | Snyder | A61F 2/52 | 623/7 |
| 2010/0068973 | A1 | 3/2010 | Tseng | | |
| 2011/0245921 | A1 * | 10/2011 | Stelter | A61F 2/52 | 623/8 |
| 2012/0010705 | A1 * | 1/2012 | Laghi | A61F 2/52 | 623/7 |
| 2013/0123917 | A1 * | 5/2013 | Riad | A61F 2/52 | 623/7 |
| 2015/0072590 | A1 | 3/2015 | Wan | | |
| 2015/0118937 | A1 | 4/2015 | Wan | | |
| 2016/0008145 | A1 * | 1/2016 | Riad | A61F 2/52 | 623/7 |
| 2018/0084841 | A1 * | 3/2018 | Calhoun | A41C 3/144 | |

OTHER PUBLICATIONS

V Cotton Mastectomy Breast Prosthesis Breast Forms, [ published to the internet on Mar. 4, 2022]; RL:https://www.amazon.com/dp/B09V34V83C/ref=twister_BO9V36JC7F. (7 pages). (Year: 2022).

* cited by examiner

ENHANCERS FOR USE WITH GARMENTS

FIELD

The present disclosure generally relates to enhancers for simulating breast tissue and that may be used with or in garments (e.g., bras, camisoles, swimsuits, sports clothing, other garments, etc.), for example, for post-mastectomy individuals or other individuals, which when used and/or worn by the individuals may reproduce (or simulate) natural breast appearances and/or natural breast shapes, etc. for the individuals.

BACKGROUND

This section provides background information related to the present disclosure which is not necessarily prior art.

Often, a diagnosis of invasive breast cancer cells for an individual may lead to the individual having a mastectomy, if chemotherapy and/or radiation treatments do not eliminate the cancer cells. Also, invasive cancers (such as stage 2*b* through stage 4) may have growths that have progressed outside of the ducts of the breasts and into the surrounding muscle tissue whereby chemotherapy and/or radiation treatments may not be options. In connection therewith, a mastectomy is a surgical procedure to remove (e.g., cut, etc.) the breast tissue off an individual's torso in order to remove the active or inactive cancer cells before metastasizing to other organs and throughout the individual's body. In some cases, election of a mastectomy by an individual may occur after genetic testing, even if the cancer cells have not yet manifested themselves (and even in lieu of chemotherapy and/or radiation).

SUMMARY

This section provides a general summary of the disclosure, and is not a comprehensive disclosure of its full scope or all of its features.

The present disclosure generally relates to enhancers (e.g., for simulating breast tissue, etc.) for use with garments. According to one aspect of the present disclosure, an enhancer for simulating breast tissue includes a first layer of material and a second layer of material coupled to the first layer of material, where the second layer of material includes a wicking material. The enhancer also includes a third layer of material and a fourth layer of material both disposed generally between the first layer of material and the second layer of material (e.g., within a cavity defined by the first and second layers of material, etc.). In one example, the third layer of material includes a plurality of monprene beads, and the fourth layer of material includes a plurality of open cell poly foam pieces. The enhancer further includes a fifth layer of material disposed at least partly between the third layer of material and the fourth layer of material, where the fifth layer of material is configured to inhibit mixing of the third and fourth layers of material (e.g., the monprene beads of the third layer and the open cell poly foam pieces of the fourth layer, etc.).

According to another aspect of the present disclosure, an enhancer for simulating breast tissue includes a body or shell (e.g., defining a cavity, etc.), a plurality of monprene beads disposed within the body (e.g., within the cavity defined by the body, etc.), and a plurality of open cell poly foam pieces disposed within the body (e.g., also within the cavity defined by the body, etc.). The monprene beads and the open cell poly foam pieces are separated within the body to inhibit mixing of the monprene beads and the open cell poly foam pieces, and are configured to simulate the appearance and/or shape of a breast.

According to another aspect of the present disclosure, a garment (e.g., a bra, a camisole, a swimsuit top, sports clothing, etc.) configured to be worn by individuals (e.g., post-mastectomy individuals, etc.) includes one or more of the above enhancers.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Figure 1:
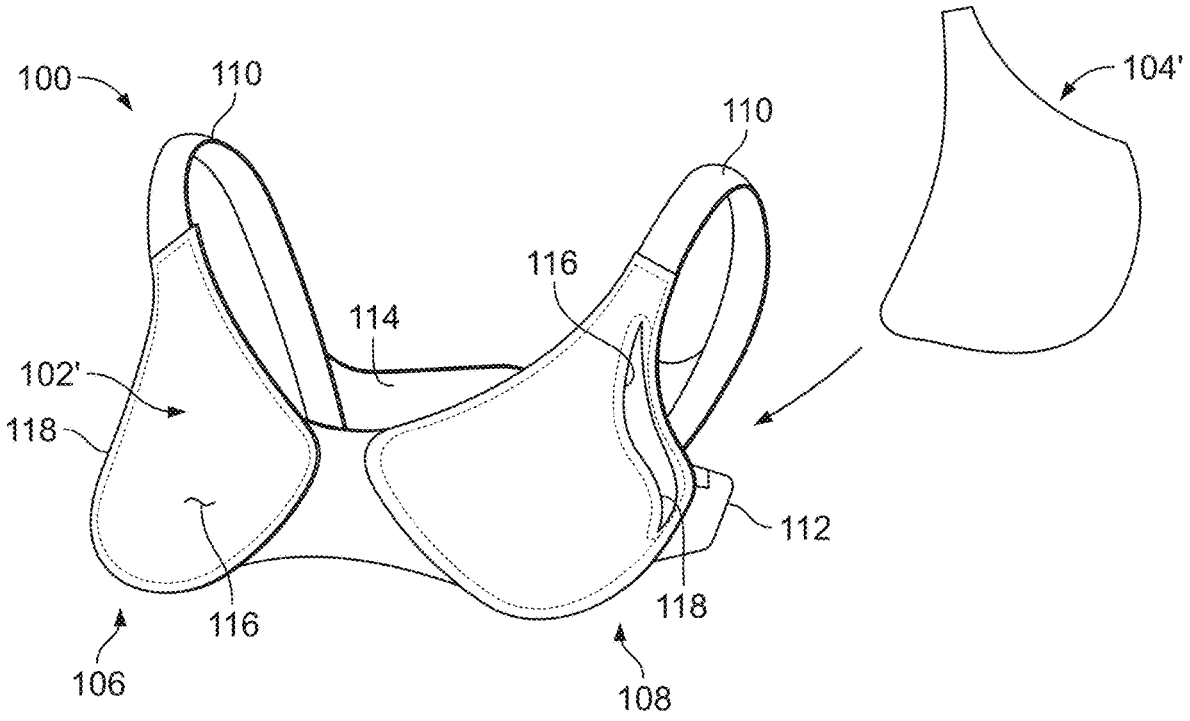
FIG. 1 is a front perspective view of a garment including first and second enhancers (e.g., right and left enhancers from a perspective of an individual wearing the garment, etc.) according to one example embodiment of the present disclosure, for instance, where the garment and enhancers may be used/worn by an individual (e.g., a post-mastectomy individual, etc.)
Figure 2:
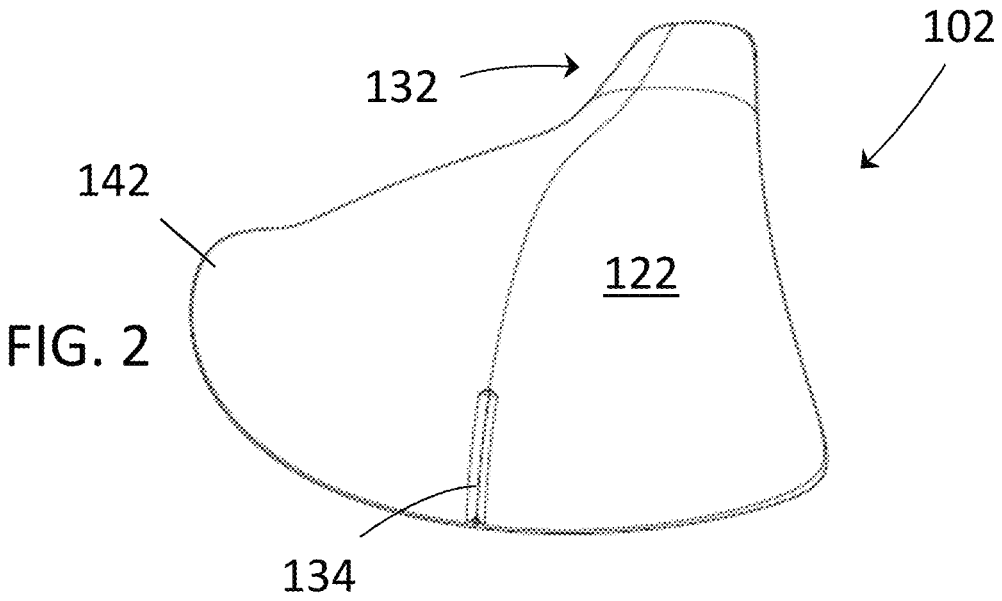
FIG. 2 is a front perspective view of a first enhancer (e.g., a right enhancer from a perspective of an individual wearing a garment including the enhancer, etc.) according to another example embodiment of the present disclosure, and where the first enhancer is suitable for use with the garment of FIG. 1.
Figure 3:
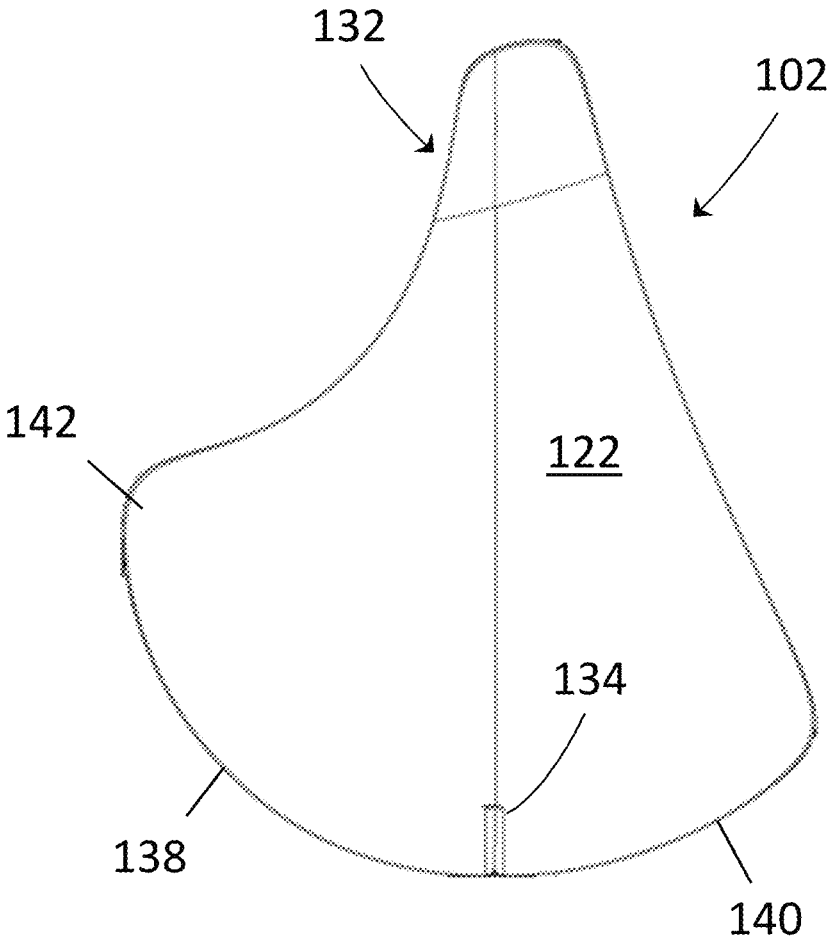
FIG. 3 is front view of the first enhancer of FIG. 2.
Figure 4:
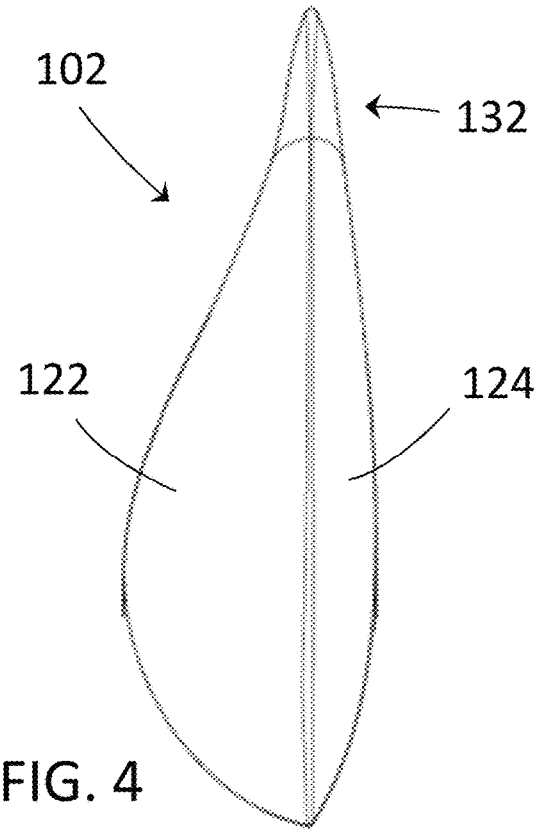
FIG. 4 is a right side view of the first enhancer of FIG. 2.
Figure 5:
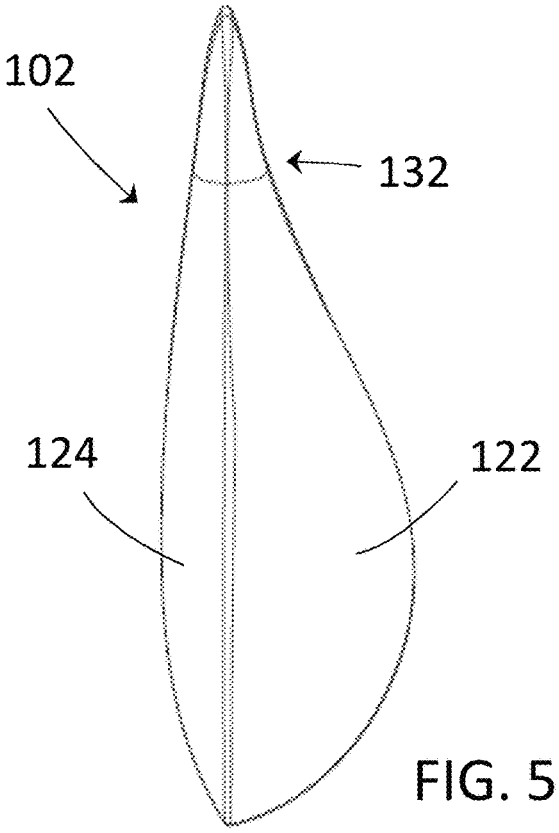
FIG. 5 is a left side view of the first enhancer of FIG. 2.
Figure 6:
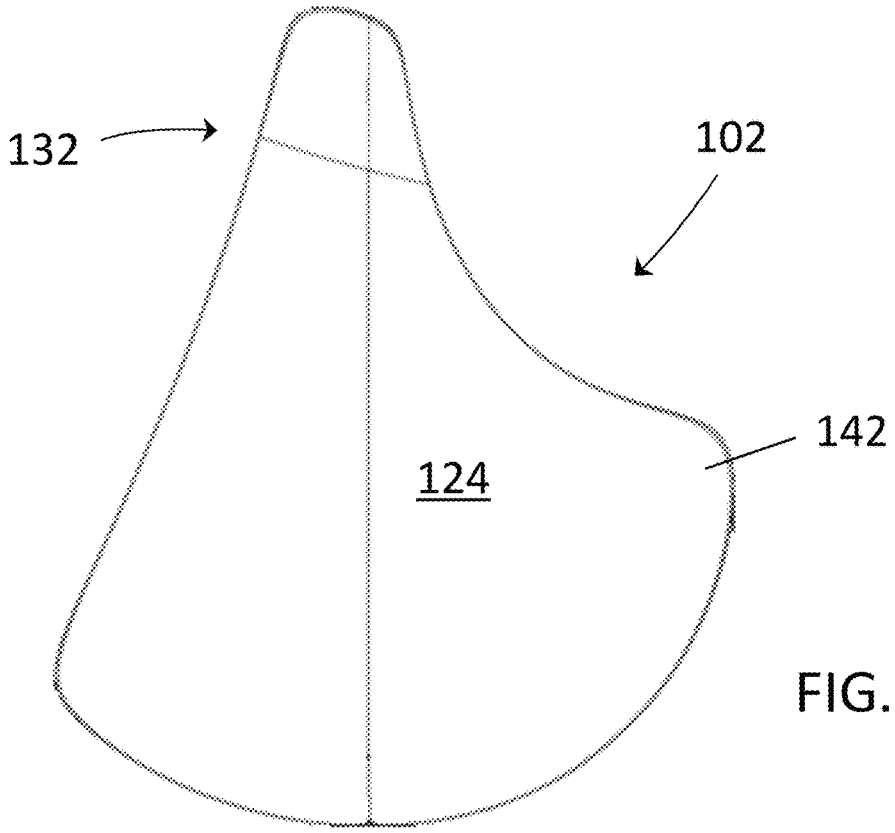
FIG. 6 is a rear view of the first enhancer of FIG. 2.
Figure 7:
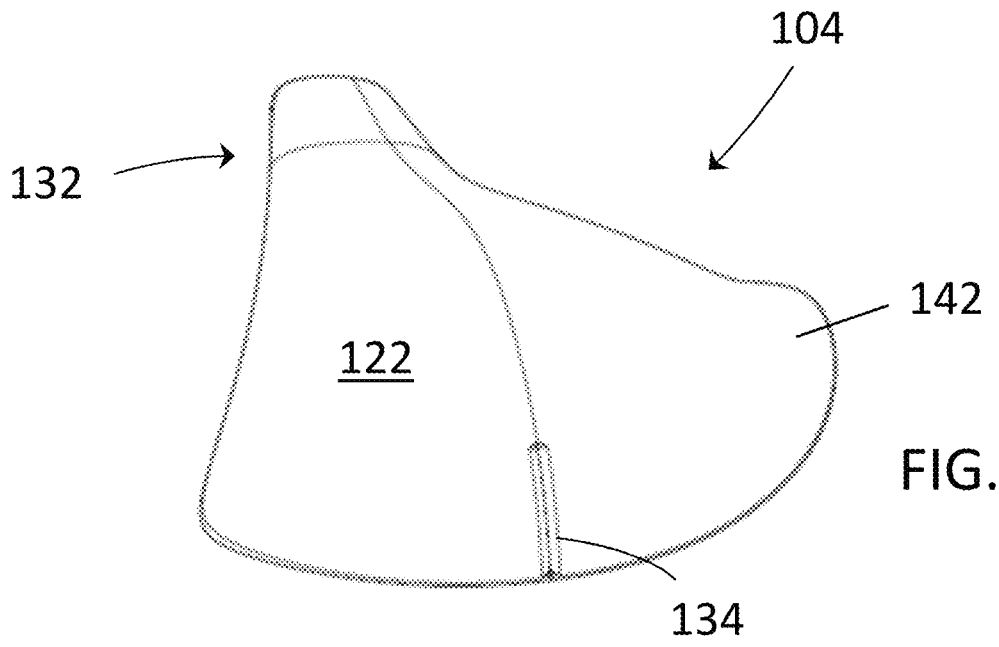
FIG. 7 is a front perspective view of a second enhancer (e.g., a left enhancer from a perspective of an individual wearing a garment including the enhancer, etc.) according to another example embodiment of the present disclosure, and where the second enhancer is suitable for use with the garment of FIG. 1.
Figure 8:
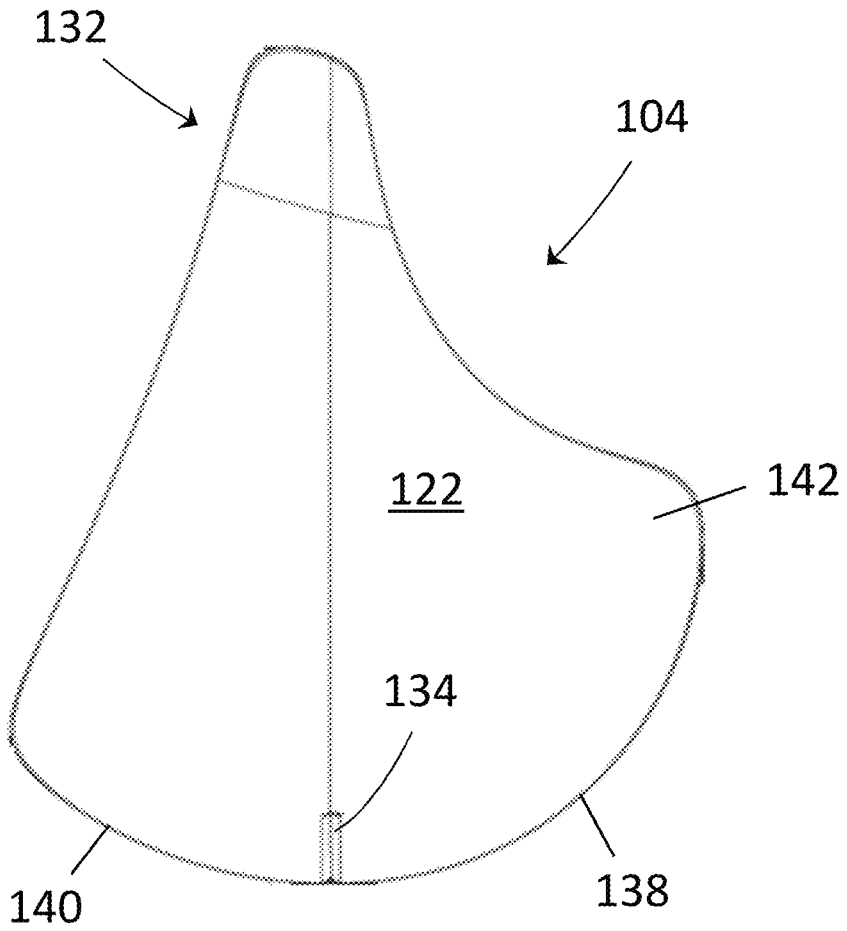
FIG. 8 is front view of the second enhancer of FIG. 7.
Figure 9:
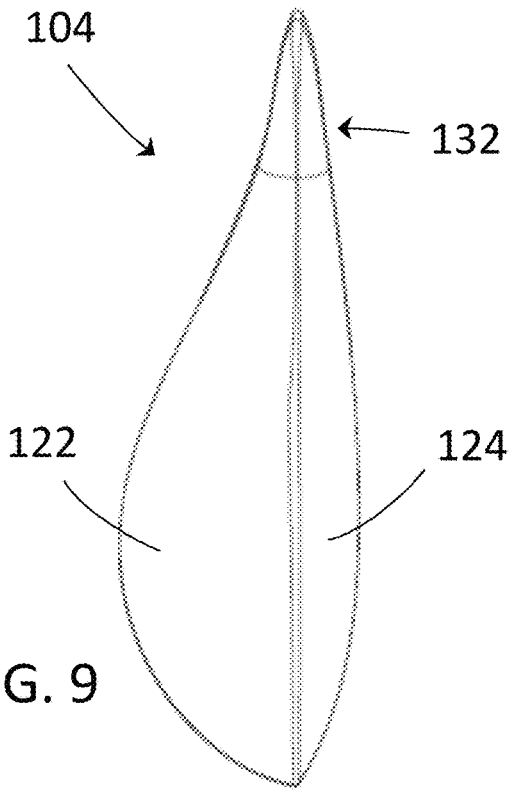
FIG. 9 is a right side view of the second enhancer of FIG. 7.
Figure 10:
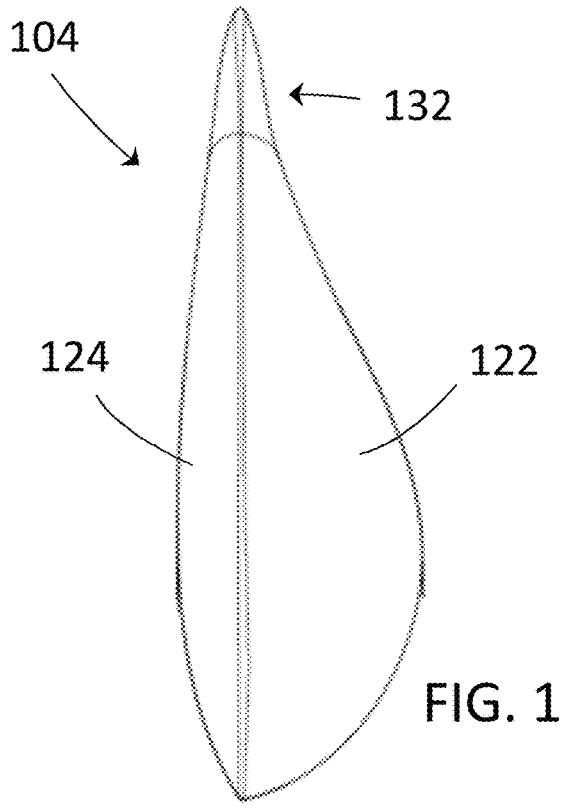
FIG. 10 is a left side view of the second enhancer of FIG. 7.
Figure 11:
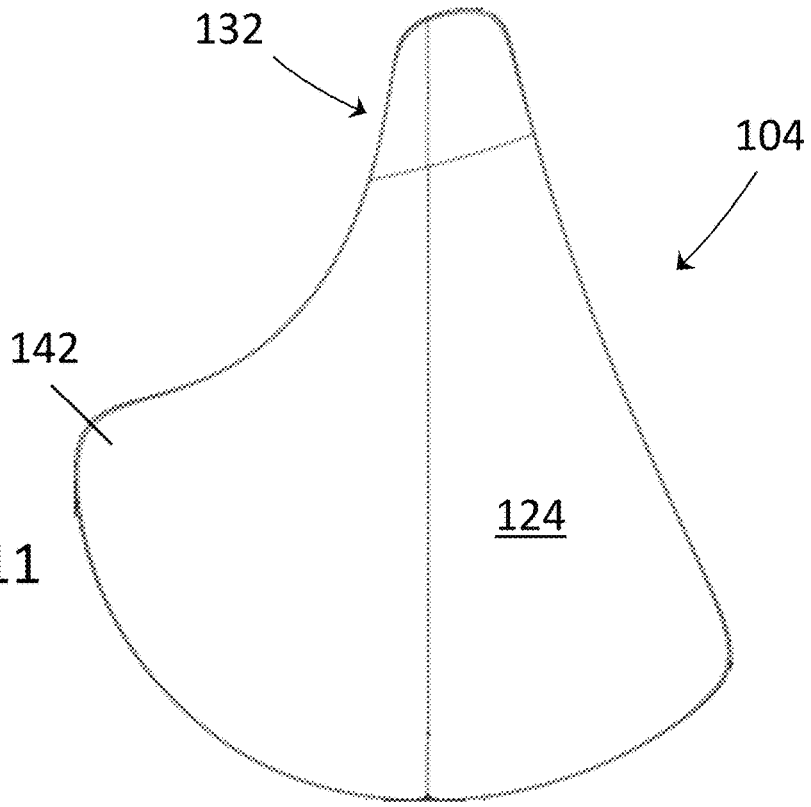
FIG. 11 is a rear view of the second enhancer of FIG. 7.
Figure 26:
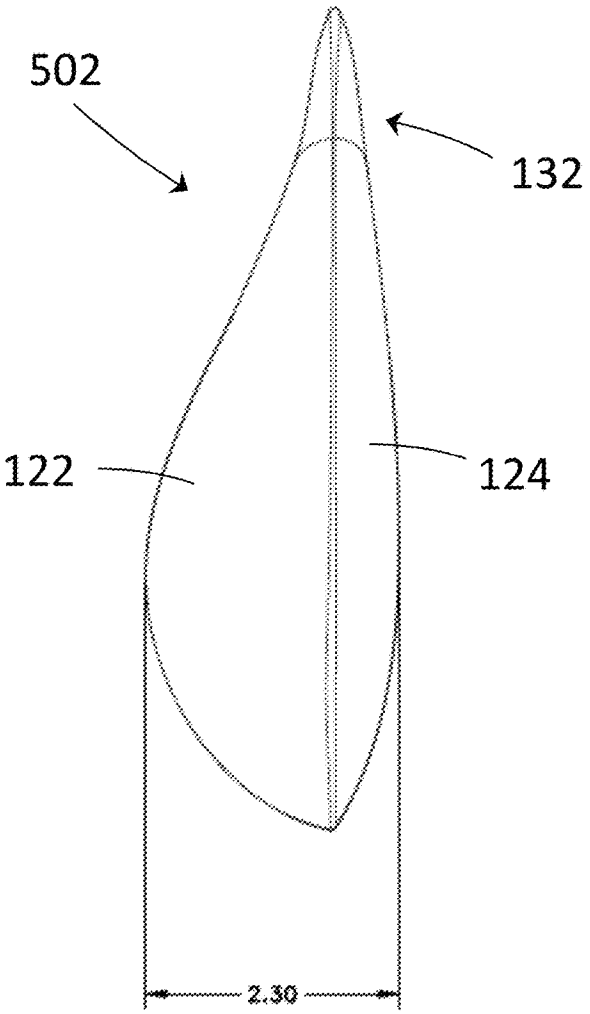
Figure 25:
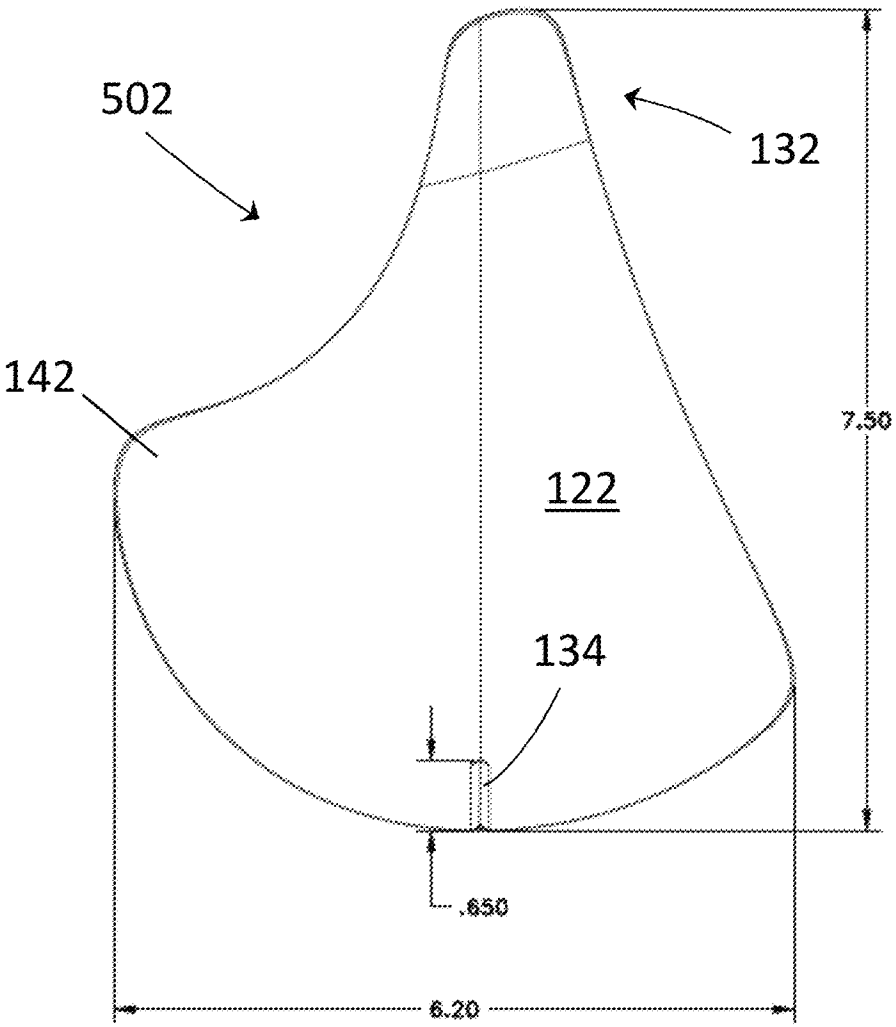
Figure 28:
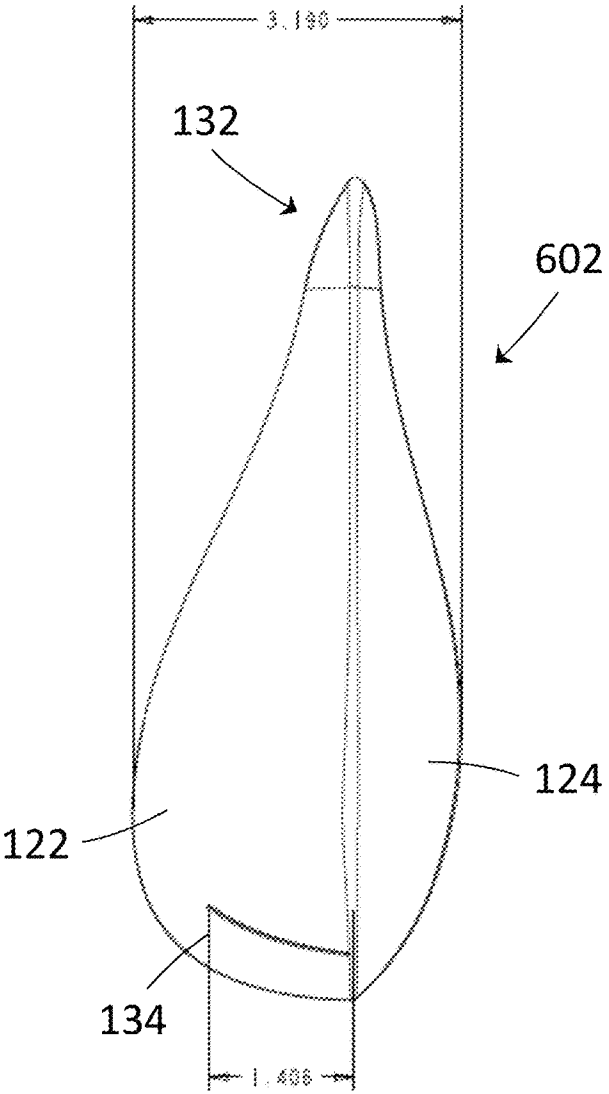
Figure 27:
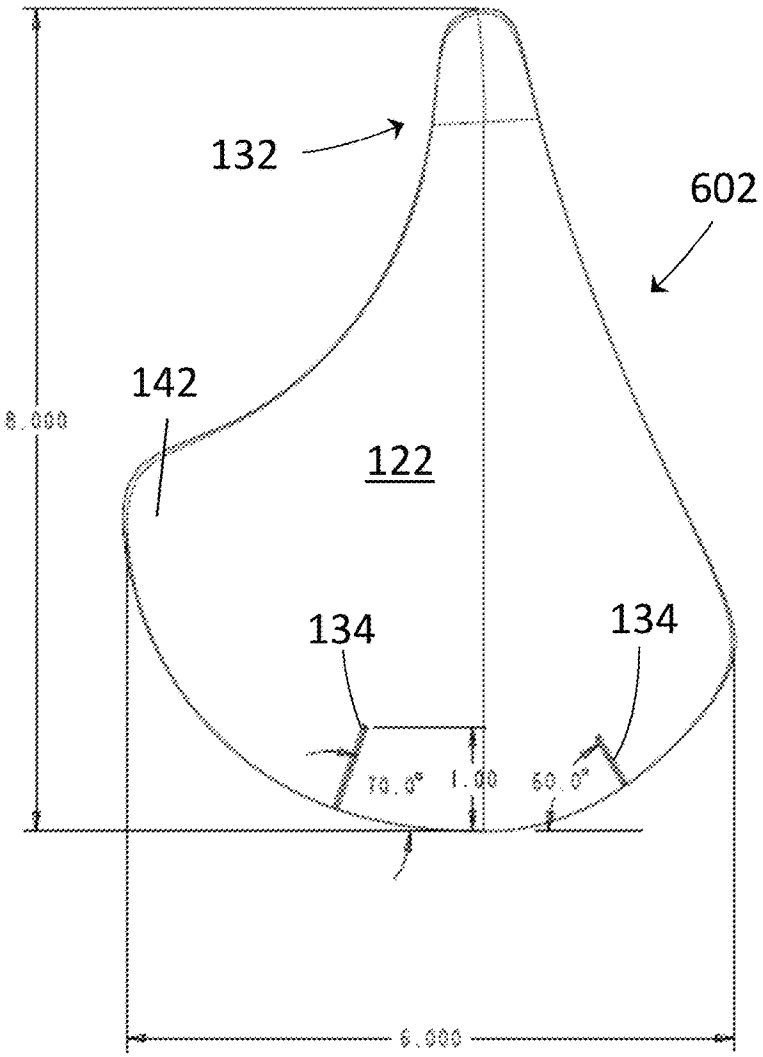

FIGS. 25-26 illustrate a first enhancer (e.g., a right enhancer from a perspective of an individual wearing a garment including the enhancer, etc.) according to a further example embodiment of the present disclosure, where the first enhancer is suitable for use with the garment of FIG. 1; and FIGS. 27-28 illustrate a first enhancer (e.g., a right enhancer from a perspective of an individual wearing a garment including the enhancer, etc.) according to still a further example embodiment of the present disclosure, where the first enhancer is suitable for use with the garment of FIG. 1.

Corresponding reference numerals indicate corresponding parts or features throughout the several views of the drawings.

DETAILED DESCRIPTION

Example embodiments will now be described more fully with reference to the accompanying drawings. The description and specific examples included herein are intended for purposes of illustration only and are not intended to limit the scope of the present disclosure.

FIG. 1 illustrates an example embodiment of a garment 100 including first and second enhancers 102', 104' (e.g., right and left enhancers from a perspective of an individual wearing the garment 100, etc.) including one or more aspects of the present disclosure. The garment 100 and enhancers 102', 104' are configured for use, for example, by individuals following a mastectomy (e.g., post-mastectomy, etc.), or by other individuals desiring to simulate breast tissue. As will be described in more detail hereinafter, the enhancers 102', 104' may reproduce the effect of a natural breast(s) and/or natural breast shape(s), etc. for an individual, when wearing the garment 100 with the enhancers 102', 104' included therein (or therewith).

In this embodiment, the garment 100 is illustrated as a bra configured to be worn by an individual (e.g., a woman, etc.), generally around or over the individual's chest. It should be appreciated, though, that the enhancers 102', 104' (as well as the other enhancers described herein) may be used with any desired garment within the scope of the present disclosure (in addition to a bra) including, for example, a swimsuit, a camisole, sports clothing, any other top or shirt, other garments, etc.

The illustrated garment 100 generally includes first and second cups 106, 108 (or cup portions) (e.g., a right cup 106 and a left cup 108, etc.) configured to fit generally over the chest of the individual (e.g., where breast material has been removed, etc.), straps 110 for holding the garment 100 over shoulders of the individual, and wings 112 (or bands) for positioning the garment 100 around sides (and under arms) of the individual wearing the garment 100. A clasp (not visible in FIG. 1) (e.g., a hook and eye coupling, etc.), then, may be provided at a back strap 114 to couple end portions of the wings 108 together adjacent a back of the individual, to secure the garment 100 on the individual 100 (and generally around the individual's chest). In other embodiments, the clasp may be positioned toward a front of the garment 100 (e.g., as one or more front closure hooks positioned between the cups 106, 108, etc.), or the clasp may be omitted (or eliminated) from the garment 100 altogether whereby the wings 108 and/or back strap 114 may extend generally continuously from a left side of the garment 100 to a right side of the garment (e.g., as in a sports bra, in a garment having a generally continuous circular knit construction, etc.).

The first cup 106 of the garment 100 includes the first enhancer 102' and the second cup 108 of the garment 100 includes the second enhancer 104'. In FIG. 1, the second enhancer 104' is shown removed from the second cup 108 of the garment 100 for illustration. That said, in the illustrated embodiment, the first and second cups 106, 108 each define a pocket 116 configured to receive the respective one of the enhancers 102', 104' therein. In particular, an opening 118 is defined in each of the cups 106, 108 whereby the enhancers 102', 104' may be positioned through the opening 118 and into the pocket 116 of the respective one of the cups 106, 108. The enhancers 102', 104' may then be secured in the garment 100 within the corresponding pocket 116 of the cups 106, 108 (e.g., via hoop-and-loop fasteners, via snap fasteners, via adhesive, etc.), or not. And, each opening 118 may be closed (e.g., via overlapping material, via hook-and-loop fasteners, via snap or button fasteners, via other mechanical fasteners, etc.) to retain the enhancers 102', 104' in the cups 106, 108. What's more, the enhancers 102', 104' may be selectively removed from the garment 100, as desired, for example, for cleaning, for use with other garments, etc. In this way, in this example embodiment, the enhancers 102', 104' may be reusable with different garments, etc.

While the illustrated garment 100 includes the two enhancers 102', 104', it should be appreciated that in other embodiments a single enhancer may be used with the garment 100 either in (or with) the first cup 106 or in (or with) the second cup 108.

FIGS. 2-6 illustrate another embodiment of a first enhancer 102 (e.g., a right enhancer, etc.) and FIGS. 7-11 illustrate another embodiment of a second enhancer 104 (e.g., a left enhancer, etc.) suitable for use with the garment 100 of FIG. 1, or with other garments as described herein. The first and second enhancers 102, 104 of this embodiment are substantially similar to the first and second enhancers 102', 104' described above with reference to FIG. 1. As such, the following description of the enhancers 102, 104 also applies to the enhancers 102', 104'.

The enhancers 102, 104 each generally include a first layer 122 (e.g., an outer layer, etc.) and a second layer 124 (e.g., an inner layer, etc.). The second layer 124 is positioned towards (e.g., close to, adjacent, in contact with, etc.) the chest of an individual when wearing the garment 100 (and when the garment includes the enhancers 102, 104). The second layer 124, then, may be connected with the first layer 122 by suitable means such as, for example, stitching, adhesive, tape, etc. generally around a perimeter of the enhancers 102, 104. Together, the first and second layers 122, 124 may be viewed as forming a body or a housing of the enhancer 102 (or enhancer 104) (e.g., defining a cavity or other space to contain or house or hold internal (or interior) components of the enhancer 102 or enhancer 104, etc.).

In the illustrated embodiment, the first layer 122 may be constructed from (or may include) a neoprene material, a molded foam material, or other convention material such as that used to form a bra, or otherwise. And, the second layer 124 may be constructed from (or may include) a wicking material such as, for example, polyester, nylon, etc.

Figure 12:
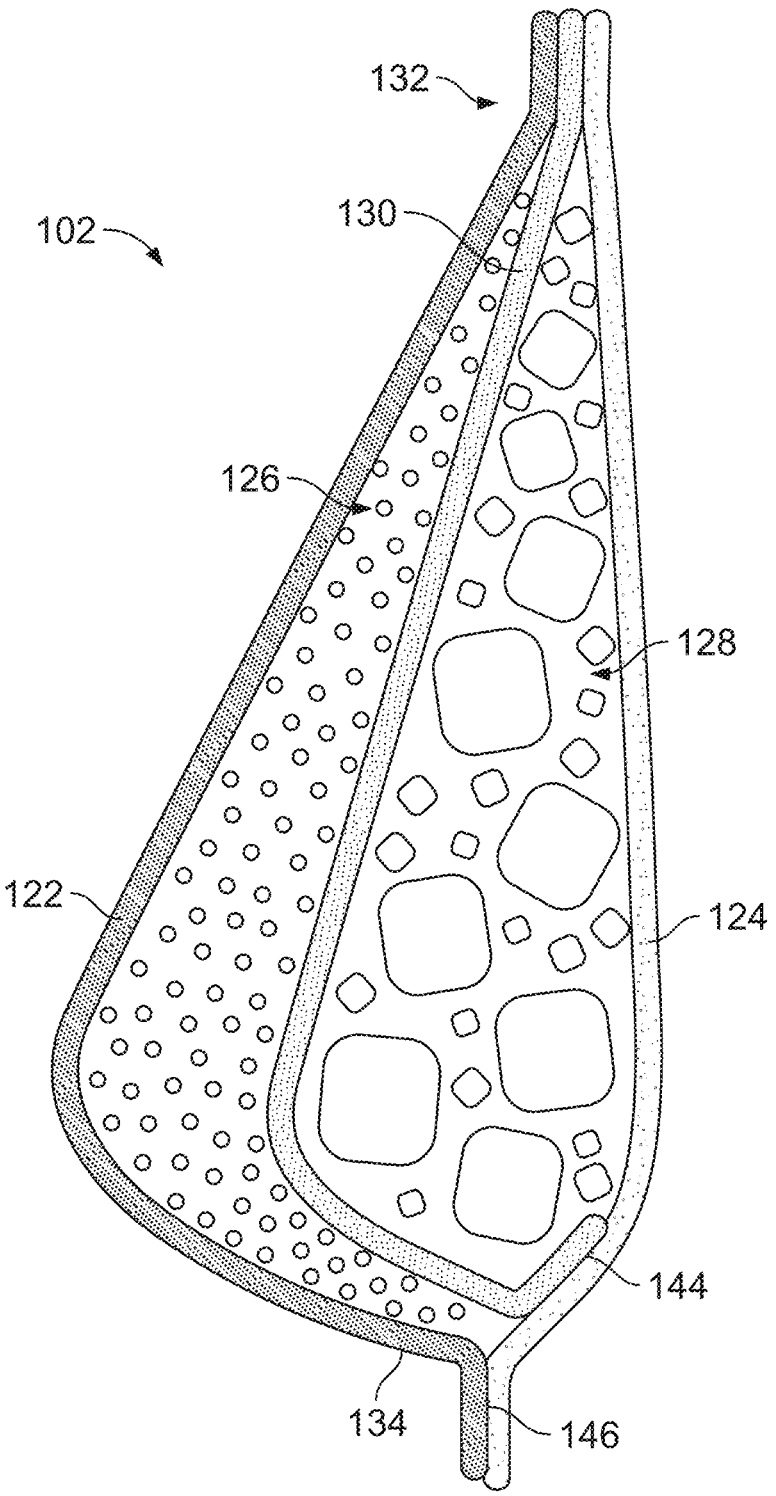
FIG. 12 is a side sectional view consistent with (and representative of) both the first and second enhancers of FIGS. 2 and 7.
Figure 13:
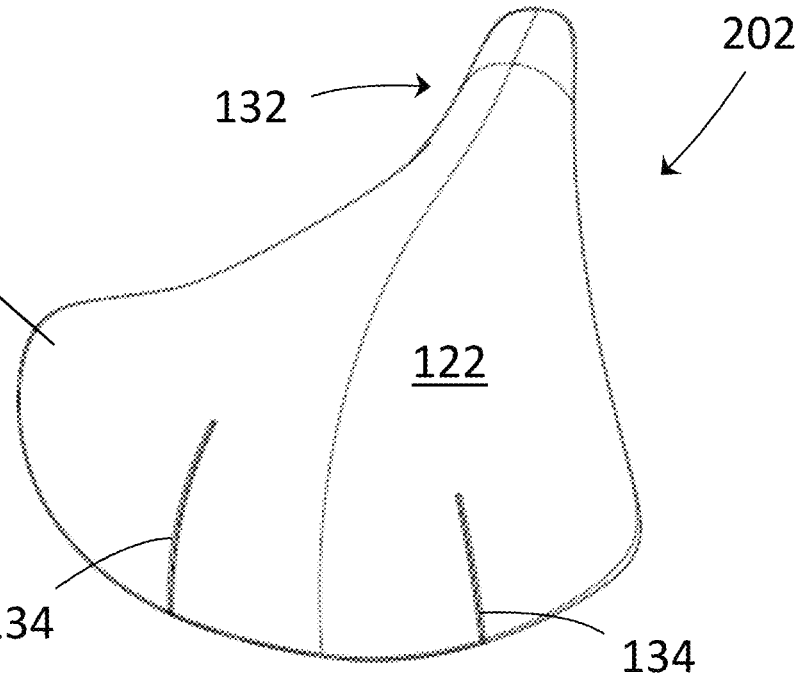
FIG. 13 is a front perspective view of a first enhancer (e.g., a right enhancer from a perspective of an individual wearing a garment including the enhancer, etc.) according to another example embodiment of the present disclosure, and where the first enhancer is suitable for use with the garment of FIG. 1.

FIG. 12 illustrates an example side sectional view representative of each of the first and second enhancers 102, 104 (i.e., both of the first enhancer 102 and the second enhancer 104 have a sectional view (and corresponding composition, construction, etc.) consistent with FIG. 12). That said, the following description of FIG. 12 is provided with general reference to the first enhancer 102. However, it should be appreciated that the description is also applicable to the second enhancer 104 (without repeating the same).

As shown, the enhancer 102 (and the enhancer 104) further includes a third layer 126 and a fourth layer 128 (e.g., interior layers of the enhancer 102, etc.) located generally within the enhancer 102 (and the enhancer 104) (e.g., within a body of the enhancer 102, within a cavity or pocket or opening or space defined by the first and second layers 122, 124 of the enhancer 102, etc.). The third layer 126 is positioned adjacent to (e.g., near, towards, in contact with, etc.) the first layer 122, and the fourth layer 128 is positioned adjacent to (e.g., near, towards, in contact with, etc.) the second layer 124. As such, the third layer 126 is disposed generally between the first layer 122 and the fourth layer 128 (e.g., within a pocket generally defined by the first layer 122 and the second layer 124, etc.), and the fourth layer 128 is disposed generally between the third layer 126 and the second layer 124 (e.g., also within the pocket generally defined by the first layer 122 and the second layer 124, etc.). In connection therewith, the third layer 126 extends along a generally forward portion of the enhancer 102, from an upper shoulder portion 132 (or extension) of the enhancer 102 to a dart 134 of the enhancer 102 generally below (or under) (at least partly) the fourth layer 128 (such that at least a portion of the third layer 126 is disposed generally below (or under) the fourth layer 128). A fifth layer 130 is then located generally between the third layer 126 and the fourth layer 128 (e.g., also within the pocket generally defined by the first layer 122 and the second layer 124, etc.), for example, to separate the two layers 126, 128.

In the illustrated embodiment, the third layer 126 may include a plurality of monprene beads. The monprene beads are configured to provide a foundation of weight to the enhancer 102 (and the enhancer 104) to mimic natural breast tissue (e.g., to mimic a weight and/or density of natural breast tissue, etc.). For instance, a weight of the monprene beads (and the beads themselves) may provide movement that appears realistic with regard to natural breast movement. In addition, the monprene beads may provide for conformity to the body of the individual when wearing the garment 100 (with the enhancer 102 (and/or the enhancer 104) included therein). In various embodiments, the monprene beads may have a density of about 1 g/cm$^3$ or less (e.g., between about 0.5 g/cm$^3$ and about 1 g/cm$^3$, about 0.89 g/cm$^3$, etc.), and/or may have diameters of between about 1 millimeter and about 3 millimeters (e.g., about 2 millimeters, etc.).

Also in the illustrated embodiment (or alternatively), the fourth layer 128 may include a plurality of differently sized open cell poly foam pieces. The open cell poly foam pieces may include the same sizes of foam pieces or various different sizes (e.g., two or more different sizes, etc.) of foam pieces. For example, in one embodiment, the fourth layer 128 may include at least two different sizes of foam pieces included therein (e.g., foam pieces having a first size and foam pieces having a second size different from the first size (e.g., having different length, width, and/or thickness dimensions, etc.), etc.). In such embodiment, the at least two different sizes of foam pieces may respond to body heat and/or movement from the individual (for example, when wearing the garment 100 including the enhancer 102 and/or the enhancer 104), and shift to conform to the individual's chest. In addition, the different sizes of foam pieces may create density (or an appearance of density) with little or minimal added weight to the enhancer 102 (or enhancer 104) and may thereby simulate fatty tissue of a breast. In various embodiments, the fourth layer 128 may include different sizes of foam pieces where the different sizes each have dimensions ranging between about 4 millimeters and about 50 millimeters (e.g., length and width dimensions ranging between about 15 millimeters and about 35 millimeters, thickness dimensions ranging between about 6 millimeters and about 20 millimeters, etc.). In connection therewith, and as described above, the second layer 124 may include a wicking material configured to further respond to different body temperatures of the individual and, potentially, configured to pull moisture away from the individual, etc. (e.g., in combination with the open cell poly foam pieces of the fourth layer 128, etc.).

In connection with the above, in various embodiments, the third layer 126 and the fourth layer 128 of the enhancer 102 (and/or the enhancer 104) may include a particular proportion of material (e.g., monprene beads, open cell poly foam pieces, etc.), based on a breast size being simulated by the enhancer. For instance, in example embodiments of enhancers where the third layer 126 includes monprene beads and the fourth layer 128 includes open cell poly foam pieces, Tables 1 and 2 provide example proportions (by weight in ounces and by volume in cups) of the monprene beads and the open cell poly foam pieces that may be included in the enhancers in order to simulate different breast sizes (e.g., breast sizes of A, B, C, D, DD, etc.).

TABLE 1

| Size | Monprene Beads (ounces) | Foam (ounces) |
|---|---|---|
| A | 3.75 | 1.5 |
| B | 4.0-4.5 | 2.25 |
| C | 5.0-5.5 | 3 |
| D | 6.0-7.0 | 3.75 |
| DD | 8.0-9.25 | 4.5 |

TABLE 2

| Size | Monprene Beads (cups) | Foam (cups) |
|---|---|---|
| A | 0.5 | 0.5 |
| B | 1 | 0.75 |
| C | 1.25-1.66 | 1 |

TABLE 2-continued

| Size | Monprene Beads (cups) | Foam (cups) |
|---|---|---|
| D | 1.75-2.25 | 1.25 |
| DD | 2.5-3.5 | 1.5 |

Further in the illustrated embodiment (or alternatively in the illustrated embodiment), the fifth layer 130 may include a mesh material (or other suitable material) located generally between the third layer 126 and the fourth layer 128. In connection therewith, the fifth layer 130 (e.g., the layer of mesh, etc.) may create a boundary between, for example, the plurality of monprene beads when included in the third layer 126 and the plurality of differently sized open cell poly foam pieces when included in the fourth layer 128, to keep the monprene beads and foam separate (e.g., to inhibit the monprene beads and foam from mixing, etc.). More generally, the fifth layer 130 is configured to inhibit material of the third layer 126 and material of the fourth layer 128 from mixing. That said, in various implementations, the fifth layer 130 may completely surround (or encapsulate, etc.) either the material of the third layer 126 (e.g., the plurality of monprene beads, etc.) or the material of the fourth layer 128 (e.g., the open cell poly foam pieces, etc.) to inhibit the materials from mixing and/or from entering other layers of the enhancer 102 (or enhancer 104).

With that said, and as generally described above, in various embodiments the first layer 122 may be constructed from (or may include) a material configured to hold its shape and/or create a generally smooth outer surface for the enhancer 102 (and the enhancer 104) to facilitate an appearance of a smooth breast. Such material may include, without limitation, a neoprene material, a molded foam material, or other suitable material. In doing so, the first layer 122 may be configured to mask uneven appearances produced by the third layer 126, for example, when the third layer 126 includes the monprene beads and/or by the fourth layer 128, for example, when the fourth layer 128 includes the open cell poly foam pieces. In this way, the first layer 122 may further help reproduce the effect of a natural breast and/or natural breast shape, etc.

In the illustrated embodiment, the shoulder portion 132 of the first and/or second enhancers 102, 104 may include at least a portion of material of the third layer 126 (e.g., the monprene beads, etc.) and/or at least a portion of the material of the fourth layer 128 (e.g., the open cell poly foam material, etc.). This may help provide for a pectoral tissue blend and a realistic transition between breast tissue and pectoral muscle into a shoulder portion of the individual (when wearing the garment 100).

As described, the illustrated enhancer 102 generally includes multiple layers of components (i.e., the first layer 122, the second layer 124, the third layer 126, the fourth layer 128, and the fifth layer 130). Uniquely, in some implementations described herein, such layers of components (or materials) may not include traditional padding. For example, in various embodiments, the first layer 122 may include a neoprene material and the second layer 124 may include a wicking material. In connection therewith, the neoprene material and the wicking material (as well as the monprene beads of the third layer 126, the foam of the fourth layer 128, and the mesh of the fifth layer 130 when included in such embodiments) may all be washable, to facilitate cleaning or washing of the enhancer 102 as part of (and generally together with) the garment 100 (e.g., without removing the enhancer 102 from the garment 100 to separately clean the garment 100 and/or the enhancer 102, etc.).

With reference again to FIGS. 2-11, the shoulder portion 132 of each of the enhancers 102, 104 is disposed toward an upper part of the enhancers 102, 104 and is configured to extend toward a shoulder of an individual wearing the garment 100, for example, in general alignment with the straps 110 of the garment 100. In some embodiments, the shoulder portion 132 may additionally include a foam material disposed therein (e.g., an additional amount of open cell poly foam pieces, etc.) configured to simulate, replace, etc. lost pectoral muscle tissue that would otherwise have been present before a mastectomy.

In addition in the illustrated embodiment, each of the enhancers 102, 104 includes the single dart 134. However, it should be appreciated that the enhancers 102, 104 may each include additional darts depending, for example, on a size of the of the enhancers 102, 104 (e.g., depending on a size of breast tissue to be simulated, etc.) (e.g., to allow an additional amount of monprene beads to settle within the lower curve of the first layer 122, etc.). In general, smaller enhancers will have fewer darts, and additional darts will be added as the size of the enhancers increases. For instance, an enhancer simulating breast sizes between AA and D may include one dart, while enhancers simulating breast sizes greater than D may include two (or three) spaced apart darts (e.g., spaced apart about two inches, about three inches, etc.) (see, e.g., enhancers 202, 204 in FIGS. 13-22, etc.). The additional darts may help the larger enhancers accommodate additional amounts of material in the third layer 126 (e.g., monprene beads, etc.) and in the fourth layer 128 (e.g., open cell poly foam pieces, etc.) required to simulate the larger breast sizes (see, e.g., Tables 1 and 2, etc.).

That said, the dart 134 of each of the illustrated enhancers 102, 104 is located in the first layer 122 (e.g., in a forward portion of the enhancers 102, 104, etc.) and is disposed toward the lower part of the enhancer 102. In connection therewith, the lower part of the first layer 122 generally defines a curve extending toward the second layer 124, where the dart 134 is then located (defined, formed, etc.) generally in the first layer 122 in a lower, underside part of the curve. The dart 134 is configured to facilitate settling of material included in the third layer 126 (e.g., the monprene beads, etc.) within the curve and first layer 122 to mimic a natural breast shape and/or curvature. In addition, the lower part of the curve, as generally formed by the dart 134 (e.g., in combination with the dart 134 itself, etc.), may also be configured to define a pocket area within the enhancer 102 that creates room for the material included in the third layer 126 to settle, for example, where the third layer 126 includes a plurality of monprene beads. To that end, in the illustrated embodiment the second layer 124 does not include the dart 134; the dart is only formed in the first layer 122.

Moreover in the illustrated embodiment, the first enhancer 102 (for example, when included in the garment 100 being worn by an individual) is configured for use over a right chest-portion of the individual (e.g., in the first cup 106, etc.) (e.g., to mimic, etc. a right breast of the individual). And, the second enhancer 104 (for example, when included in the garment 100 being worn by an individual) is configured for use over a left chest-portion of the individual (e.g., in the second cup 108, etc.) (e.g., to mimic, etc. a left breast of the individual). In connection therewith, a portion 138 of the curve of the first layer 122 (for each of the enhancers 102, 104), on a side of the enhancer 102, 104 extending toward an underarm of the individual (e.g., generally to the left of the dart 134 of the first enhancer 102 as viewed in FIG. 3 and generally to the right of the dart 134 of the second enhancer 104 as viewed in FIG. 8, etc.), is longer in length (and defines a generally higher curve) than a portion 140 of the curve on a side of the enhancer 102 extending toward a center of a chest of the individual (e.g., generally to the right of the dart 134 of the first enhancer 102 as viewed in FIG. 3 and generally to the left of the dart 134 of the second enhancer 104 as viewed in FIG. 8, etc.). In this way, the enhancers 102, 104 define a particular shape (e.g., a breast shape, etc.) that includes not only the shoulder portion 132, but also a side-breast portion 142 (defining the generally higher curve of the enhancer 102, 104), both of which help blend appearance of the enhancers 102, 104 onto an individual's body as a natural breast shape. What's more, this shape may further provide symmetry on a front of the individual's chest, when wearing the garment 100, (by way of the specifically configured enhancers 102, 104).

An example operation of making the enhancers 102, 104 will be described next. In this example, each of the enhancers 102, 104 may be assembled generally layer by layer, through use of machine stitching. For instance, material for the first, second, and fifth layers 122, 124, 130 may initially be cut to desired shapes for the enhancers 102, 104 (e.g., the shapes shown in FIGS. 3, 6, 8, 11, etc.). Next, the dart 134 may be formed in the first layer 122 by folding and cutting a section (e.g., about a one inch cut, etc.) in the lower arc of the first layer 122 and stitching the two cut sides together. The fifth layer 130 may then be stitched to the second layer 124 around a perimeter of the fifth layer 130 (e.g., at 144 in FIG. 12, etc.), to thereby define a pocket between the second layer 124 and the fifth layer 130, while leaving an opening (or unstitched section) to allow for positioning of the open cell poly foam pieces in the pocket. Similarly, the first layer 122 may be stitched to the second layer 124 around a perimeter of the first and second layers 122, 124 (e.g., at 146 in FIG. 12, etc.), to thereby define another pocket between the first layer 122 and the fifth layer 130, while again leaving an opening (or unstitched section) to allow for positioning of the monprene beads in the pocket.

Next, the open cell poly foam pieces may be positioned in the shoulder portion 132, and stitched in place. The monprene beads may be added to the pocket between the first layer 122 and the fifth layer 130, and the opening thereto is stitched closed. And, additional open cell poly foam pieces may be added to the pocket between the second layer 124 and the fifth layer 130, and the opening thereto is stitched closed.

FIGS. 13-22 illustrate another embodiment of first and second enhancers 202, 204 suitable for use with the garment 100 of FIG. 1, or with other garments as described herein. The first and second enhancers 202, 204 of this embodiment are substantially the same as the first and second enhancers 102, 104 described above with reference to FIGS. 2-12. As such, the description of the enhancers 102, 104 above also applies to the enhancers 202, 204 (with corresponding reference numbers in FIGS. 13-22 indicating corresponding parts to those described above with reference to the enhancers 102, 104). That said, in this embodiment, the enhancers 202, 204 are configured to simulate larger amounts of breast tissue. As such, each of the enhancers 202, 204 includes two darts 134 to help accommodate the larger size of the enhancers 202, 204 and to help allow the additional material added in the third layer 126 (to accommodate the larger size of the enhancers 202, 204) to settle within the lower curved portion of the first layer 122.

Figure 14:
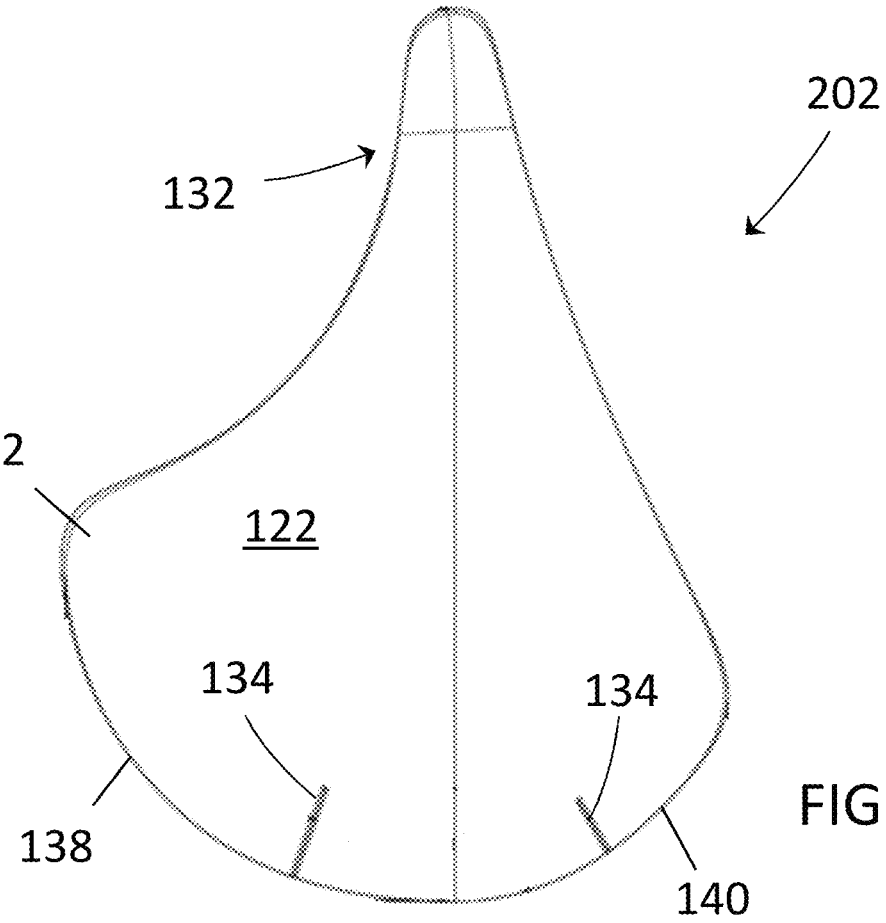
FIG. 14 is front view of the first enhancer of FIG. 13.
Figure 15:
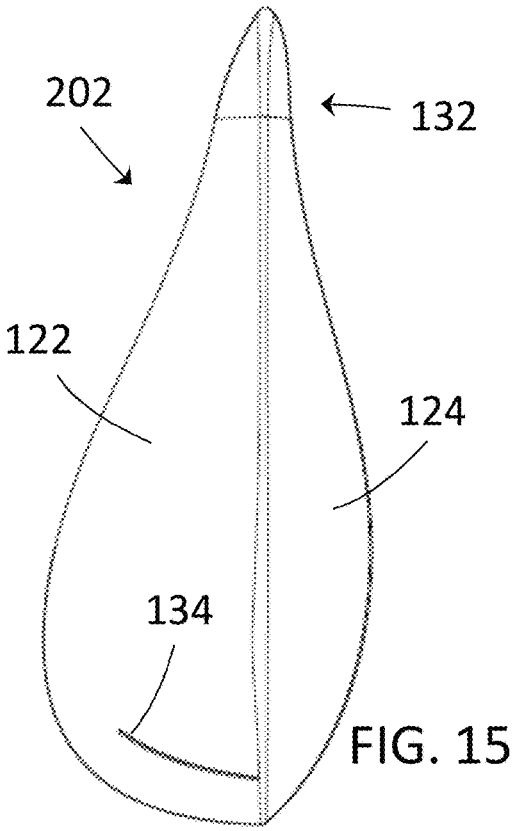
FIG. 15 is a right side view of the first enhancer of FIG. 13.
Figure 16:
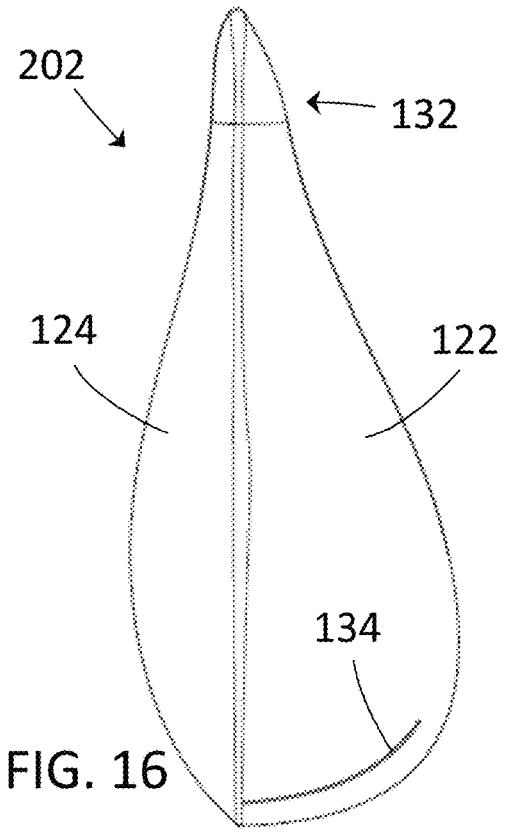
FIG. 16 is a left side view of the first enhancer of FIG. 13.
Figure 17:
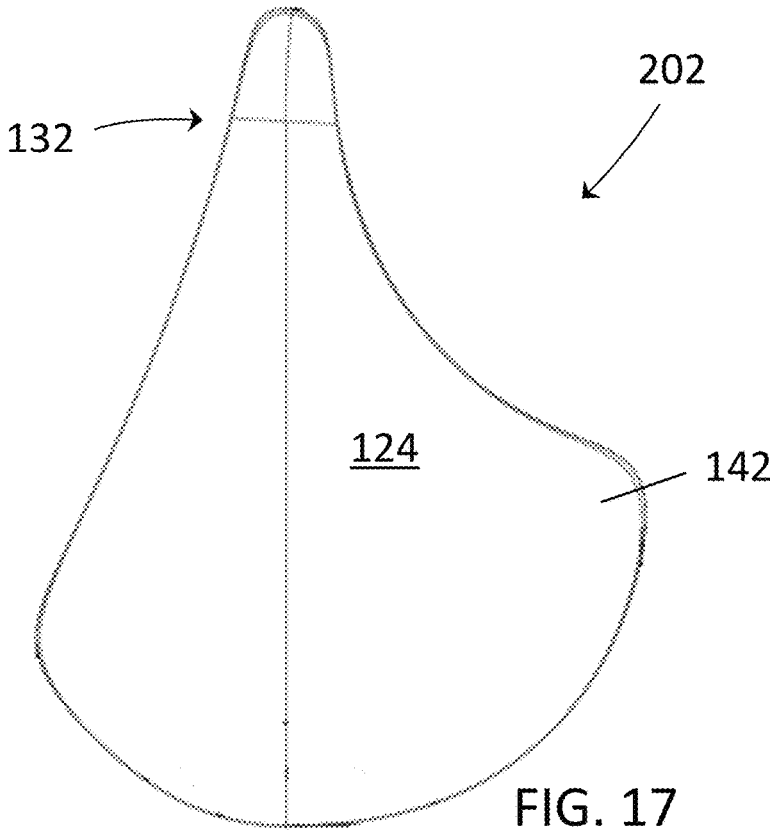
FIG. 17 is a rear view of the first enhancer of FIG. 13.
Figure 18:
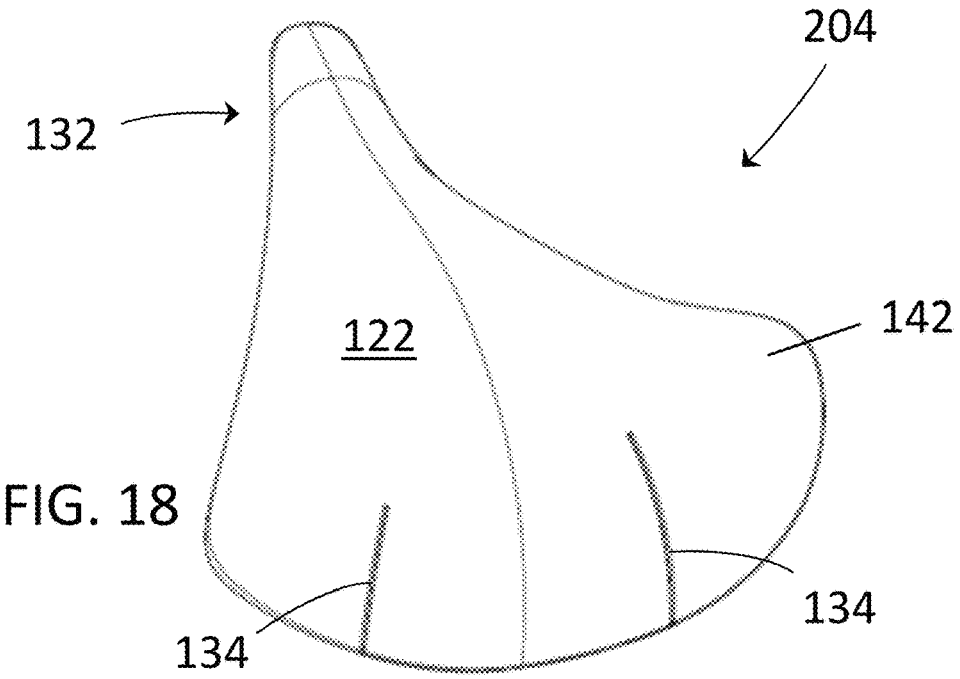
FIG. 18 is a front perspective view of a second enhancer (e.g., a left enhancer from a perspective of an individual wearing a garment including the enhancer, etc.) according to another example embodiment of the present disclosure, where the first enhancer is suitable for use with the garment of FIG. 1.
Figure 19:
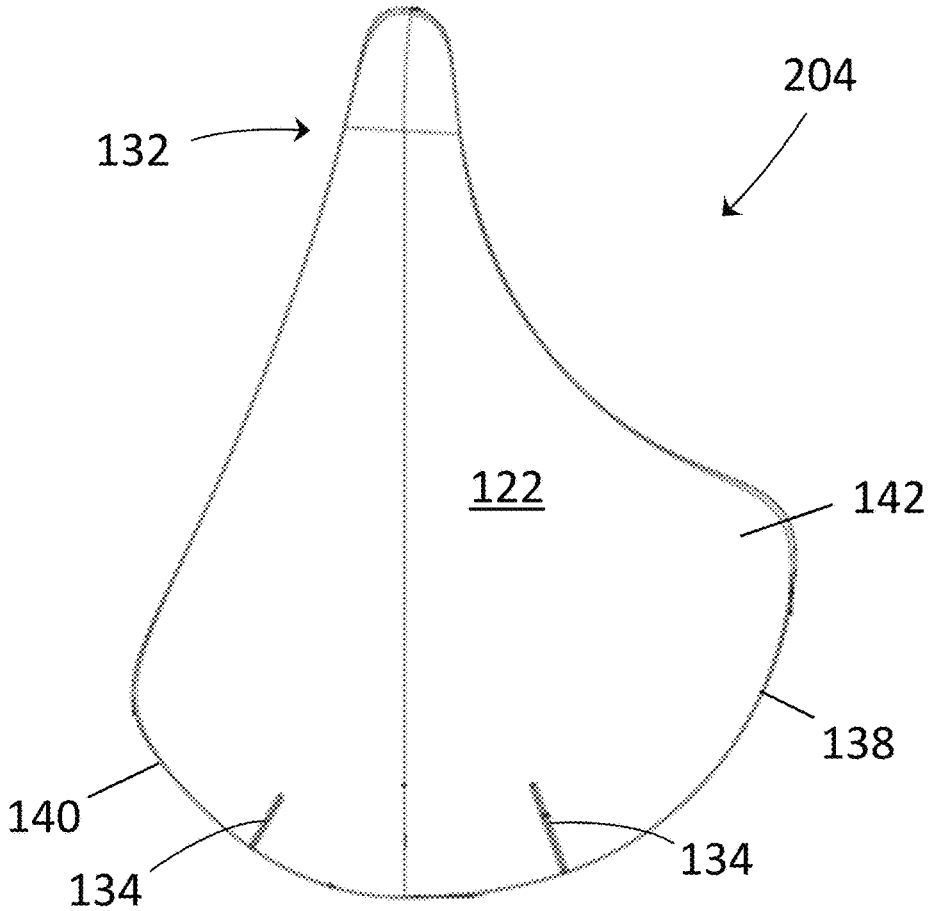
FIG. 19 is front view of the second enhancer of FIG. 18.
Figure 20:
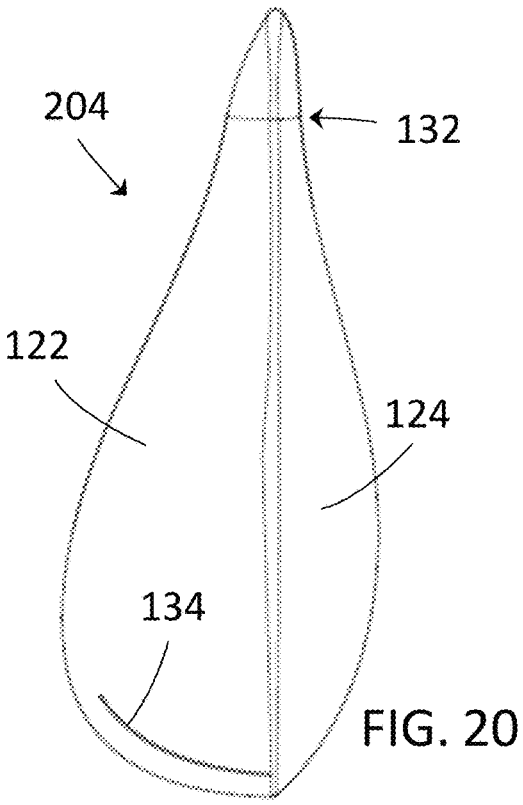
FIG. 20 is a right side view of the second enhancer of FIG. 18.
Figure 21:
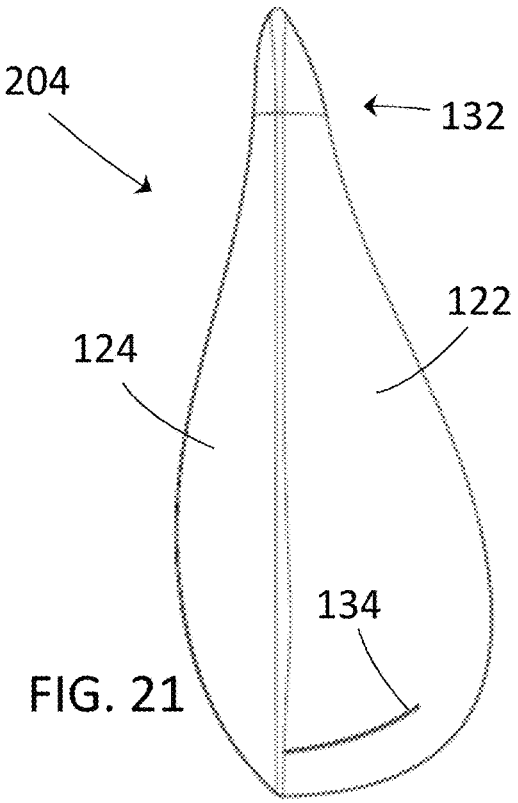
FIG. 21 is a left side view of the second enhancer of FIG. 18.
Figure 22:
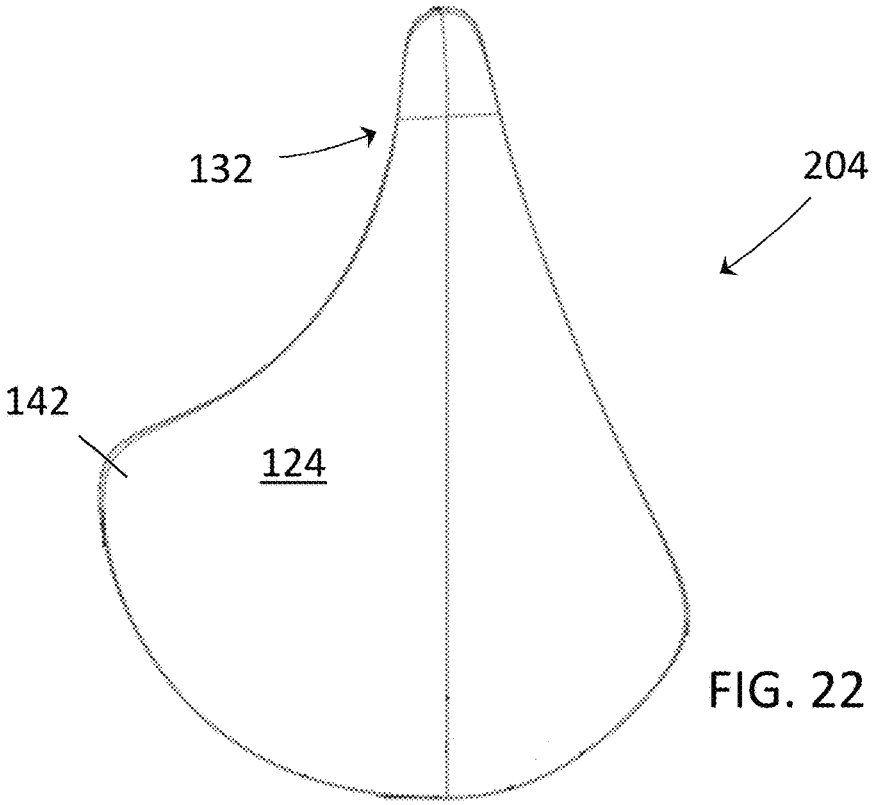
FIG. 22 is a rear view of the second enhancer of FIG. 18.

In addition in this embodiment, the portion 138 of the curve of the first layer 122 (for each of the enhancers 202, 204), on a side of the enhancer 202, 204 extending toward an underarm of the individual (e.g., generally to the left of the left-most dart 134 of the first enhancer 202 as viewed in FIG. 14 and generally to the right of the right-most dart 134 of the second enhancer 204 as viewed in FIG. 19, etc.), is longer in length than a portion 140 of the curve on a side of the enhancer 102 extending toward a center of a chest of the individual (e.g., generally to the right of the right-most dart 134 of the first enhancer 202 as viewed in FIG. 14 and generally to the left of the left-most dart 134 of the second enhancer 204 as viewed in FIG. 19, etc.).

Figure 23:
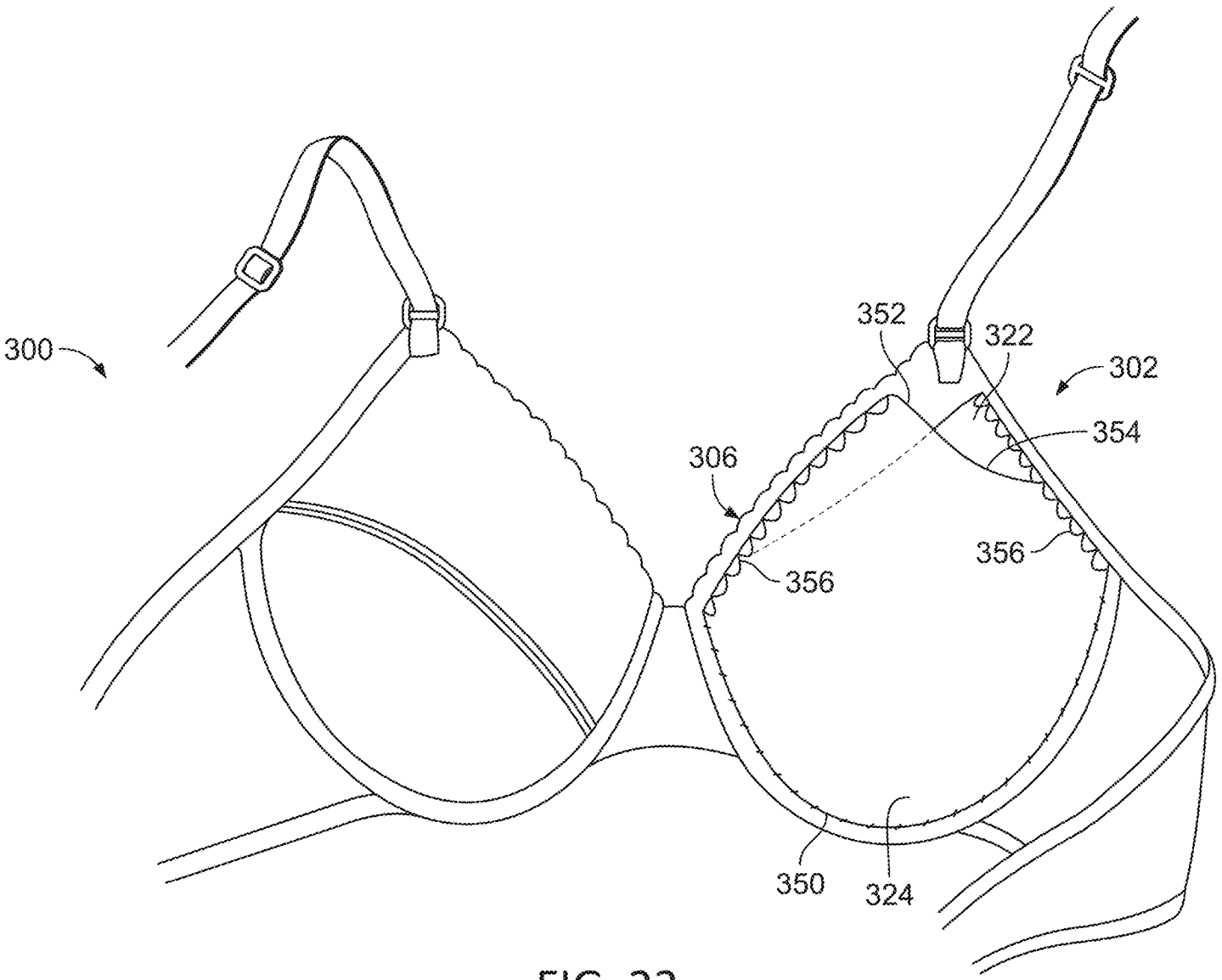
FIG. 23 is a rear view of an enhancer according to still another example embodiment of the present disclosure, where the enhancer is included in a cup of a bra and illustrating example stitching coupling the enhancer to an inside of the cup of the bra.

FIG. 23 illustrates a rear view of a garment 300 including another example embodiment of an enhancer 302 of the present disclosure (e.g., a right enhancer, etc.). The enhancer 302 is substantially similar to the first enhancer 102 described above with reference to FIGS. 2-12. As such, the description of the enhancer 102 above also generally applies to the enhancer 302 (unless indicated otherwise herein).

In this embodiment, the enhancer 302 is shown coupled (or installed) in a cup 306 of the garment 300. The garment 300 is illustrated as a bra in this embodiment, with the enhancer 302 shown positioned within the cup 306 of the bra. It should again be appreciated that in other embodiments, the garment 300 may include other garments (other than bras) configured to be worn by or worn over the chest of an individual.

The enhancer 302 includes a first layer 322 and a second layer 324. The first layer 322 is a separate layer of material from the material used to form the cup 306 of the garment 300. As such, to couple (or install) the enhancer 302 to the garment 300, the enhancer 302 is stitched to the garment 300 generally along outer edges thereof within the cup 306 of the garment 300.

In one implementation of this embodiment, in forming the enhancer 302, a lower portion of peripheral edges of the first layer 322 and the second layer 324 may be initially sewed together and into a lower portion of the cup 306 of the garment at seam/stitch 350. As appropriate, then, a fifth layer of material may be added between the first and second layers 322, 324 (the fifth layer is not visible in FIG. 23, but is substantially the same as layer 130 described above for the enhancer 102). In doing so, an opening 352 is left (or remains) at an upper part of the enhancer 302 (e.g., at a shoulder portion of the garment 300, etc.) to provide access to pockets between the first layer 322 and the fifth layer and between the second layer 324 and the fifth layer to receive, for example, monprene beads (as a third layer) and open cell poly foam pieces (as a fourth layer). Then, edges 354 of the opening 352 may be finished (e.g., sewed together, etc.) and zigzag lining (or sewing), at seam 356, may be added along outer edges of the enhancer 302.

Alternatively, as another implementation of this embodiment, the enhancer 302 may be initially constructed as described above for the enhancer 102. The constructed enhancer 302 may then be sewn into the cup 306 of the garment 300 around its perimeter (as described, for example, via seams 350, 356, etc.).

With that said, in this example embodiment, the enhancer 302 may be permanent to the garment 300 (e.g., due to stitching, etc.). This may help retain dignity for the individual, as it requires one less component to put together after a mastectomy. Such a permanent attachment of the enhancer 302 to the garment 300 may also help maintain a consistent location of the enhancer 302 in the garment 300, a consistent look of the garment 300, etc., across multiple wears, washes, etc. In various implementations, the garment 300 may also be modified by removing and changing the enhancer 302 according to a lifestyle or purpose of the garment 300, etc.

Figure 24:
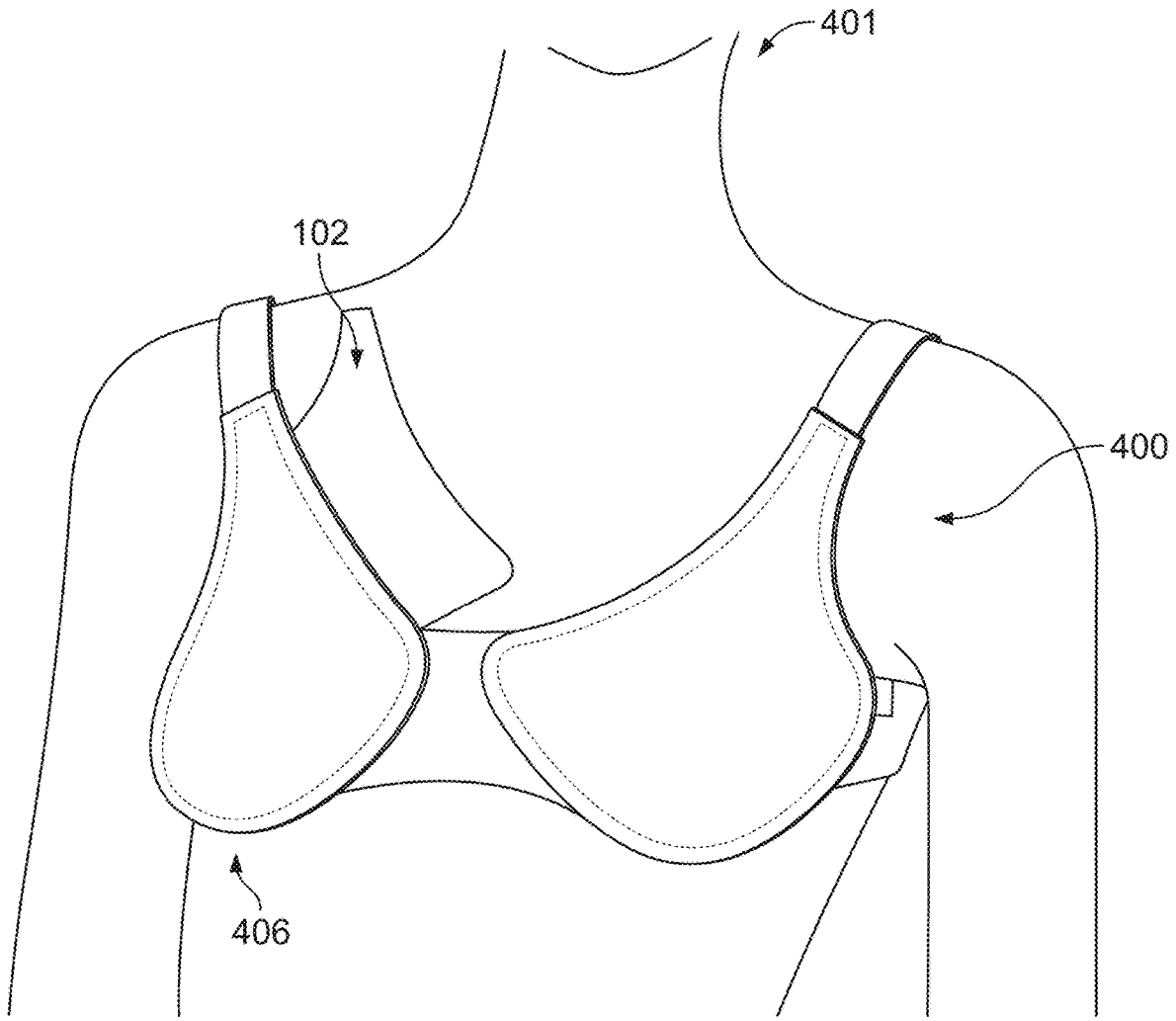
FIG. 24 illustrates another use of an enhancer according to an example embodiment of the present disclosure, where the enhancer may be positioned within a cup of a garment worn by an individual between the garment and a portion of the individuals' body.

FIG. 24 illustrates another example use of the enhancer 102, in which the enhancer 102 may be positioned (as indicated by the arrow in FIG. 24) within a cup 406 of a garment 400 generally between the garment 400 and a chest portion of an individual 401 wearing the garment 400. In this use, the enhancer 102 is not inserted into a cavity or pocket defined by the cup 406 of the garment 400 nor is it stitched to the garment 400. Instead, the enhancer 102 simply rests within the cup 406 of the garment 400 generally adjacent (e.g., close to, against, etc.) the chest portion of the individual.

FIGS. 25-28 illustrate two additional embodiments of enhancers 502, 602 both suitable for use with the garment 100 of FIG. 1, or with other garments as described herein. The enhancer 502 (FIGS. 25-26) is substantially similar to the first enhancer 102 described above with reference to FIGS. 2-12. As such, the description of the enhancer 102 above also generally applies to the enhancer 502 (with corresponding reference numbers in FIGS. 25-26 indicating corresponding parts to those described above with reference to the enhancer 102). Similarly, the enhancer 602 (FIGS. 27-28) is substantially similar to the first enhancer 202 described above with reference to FIGS. 13-17. As such, the description of the enhancer 202 above also generally applies to the enhancer 602 (with corresponding reference numbers in FIGS. 27-28 indicating corresponding parts to those described above with reference to the enhancer 202). That said, in this embodiment, example dimensions (in inches) are provided for different parts of the enhancers 502, 602. It should be appreciated, though, that other enhancers herein may have one or more other dimensions within the scope of the present disclosure.

In further embodiments, an enhancer may be formed directly in or with a garment. For example, a first layer of the enhancer may be defined by a cup of the garment, and the remaining layers then formed, as described above, relative to the cup (acting as the first layer). In such embodiments, the enhancer may be viewed as integral with or formed as part of the garment (whereby the garment itself may define or may be viewed as an enhancer).

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An enhancer for simulating breast tissue, the enhancer comprising:

a forward, first layer of material;

a rearward, second layer of material for positioning adjacent a chest of an individual, the second layer of material coupled to the first layer of material, the second layer of material including a wicking material;

a third layer of material disposed generally between the first layer of material and the second layer of material, the third layer of material including a plurality of thermoplastic elastomer beads;

a fourth layer of material disposed generally rearward of the third layer of material and generally between the first layer of material and the second layer of material, the fourth layer of material including a plurality of open cell poly foam pieces; and a fifth layer of material coupled to the second layer of material and disposed at least between the third layer of material and the fourth layer of material, the fifth layer of material configured to inhibit mixing of the thermoplastic elastomer beads of the third layer and the open cell poly foam pieces of the fourth layer;

wherein the third layer of material is further disposed generally between the first layer of material and the fifth layer of material; and wherein the fourth layer of material is further disposed generally between the second layer of material and the fifth layer of material.

2. The enhancer of claim 1, wherein at least part of the third layer of material engages the rearward, second layer of material at a location generally below the fourth layer of material.

3. The enhancer of claim 1, wherein the first layer of material is coupled to the second layer of material via stitching.

4. The enhancer of claim 1, wherein the first layer of material defines a curve toward a lower part of the first layer of material; and wherein the enhancer further includes at least one dart disposed on an underside of the curve.

5. The enhancer of claim 4, wherein the curve defines a pocket area configured to receive the plurality of thermoplastic elastomer beads.

6. The enhancer of claim 4, wherein the at least one dart is formed in only the first layer of material.

7. The enhancer of claim 1, wherein the plurality of open cell poly foam pieces include at least one piece having a first size, and another piece having a second size different from the first size.

8. The enhancer of claim 1, further comprising a shoulder portion defined by at least the first layer of material and the second layer of material, the shoulder portion forming an upper portion of the enhancer and including at least one foam material.

9. A garment including the enhancer of claim 1.

10. An enhancer for simulating breast tissue, the enhancer comprising:

a body having a rearward layer for positioning adjacent a chest of an individual and a forward layer generally opposite the rearward layer;

a plurality of thermoplastic elastomer beads disposed within the body adjacent the forward layer;

a plurality of open cell poly foam pieces disposed within the body rearward of the plurality of thermoplastic elastomer beads and adjacent the rearward layer; and a mesh layer disposed within the body between the thermoplastic elastomer beads and the open cell poly foam pieces, the mesh layer configured to separate the thermoplastic elastomer beads and the open cell poly foam pieces within the body to inhibit mixing of the thermoplastic elastomer beads and the open cell poly foam pieces.

11. The enhancer of claim 10, wherein the plurality of open cell poly foam pieces include at least one piece having a first size, and another piece having a second size different from the first size.

12. The enhancer of claim 10, wherein the body includes at least one dart.

13. The enhancer of claim 12, wherein the body defines a curve toward a lower part of the body; and wherein the at least one dart is disposed on an underside of the curve.

14. The enhancer of claim 12 wherein the body includes at least two darts.

15. The enhancer of claim 10, wherein the body includes a shoulder portion that forms an upper portion of the body, the shoulder portion including a plurality of open cell poly foam pieces.

16. A garment including the enhancer of claim 10.

17. The enhancer of claim 10, wherein a ratio of the thermoplastic elastomer beads and the open cell poly foam pieces is between about 1.5:1 and about 3:1.

18. The enhancer of claim 10, wherein a density of the thermoplastic elastomer beads is about 1 $g/cm^3$ or less.

19. The enhancer of claim 10, wherein the body includes a shoulder portion that forms an upper portion of the body; and wherein the plurality of thermoplastic elastomer beads extend along the forward layer of the body from the shoulder portion to the rearward layer at a location generally below the plurality of open cell poly foam pieces.

* * * * *